US006444330B1

(12) United States Patent
Abels

(10) Patent No.: US 6,444,330 B1
(45) Date of Patent: Sep. 3, 2002

(54) COMPOSITE PART CONTAINING METALLIC FOAM AND METHOD FOR PRODUCING SAID COMPOSITE PART

(75) Inventor: Olaf Abels, Belm (DE)

(73) Assignee: ZF Lemförder Metallwaren AG (DE)

( * ) Notice: Subject to any disclaimer, the term of this patent is extended or adjusted under 35 U.S.C. 154(b) by 0 days.

(21) Appl. No.: 09/700,105

(22) PCT Filed: Mar. 7, 2000

(86) PCT No.: PCT/DE00/00670

§ 371 (c)(1),
(2), (4) Date: Dec. 12, 2000

(87) PCT Pub. No.: WO00/54911

PCT Pub. Date: Sep. 21, 2000

(30) Foreign Application Priority Data

Mar. 12, 1999 (DE) ..... 199 11 213

(51) Int. Cl.[7] ..... B22F 3/11; B22F 7/04; B32B 5/02; B32B 15/01; B32B 15/16

(52) U.S. Cl. ..... 428/550; 428/554; 428/558; 428/566; 428/613; 428/650; 419/8; 419/9; 419/66

(58) Field of Search ..... 428/550, 554, 428/558, 566, 613, 650; 419/8, 9, 66

(56) References Cited

U.S. PATENT DOCUMENTS 5,564,064 A * 10/1996 Martin
5,972,521 A * 10/1999 Huskamp et al.
6,085,965 A * 7/2000 Schwartz et al.
6,094,798 A * 8/2000 Seeliger et al.

FOREIGN PATENT DOCUMENTS

| | | |
|---|---|---|
| DE | 44 26 627 A1 | 2/1995 |
| DE | 196 12 781 C1 | 8/1997 |
| DE | 195 01 508 C1 | 4/1998 |
| EP | 0 744 586 A1 | 11/1996 |
| WO | WO 99/52661 | 10/1999 |

* cited by examiner

*Primary Examiner*—Deborah Jones
*Assistant Examiner*—Jason Savage
(74) *Attorney, Agent, or Firm*—McGlew and Tuttle, P.C.

(57) ABSTRACT

A sandwich component, which comprises at least two massive metallic sheet metal parts located opposite one another and a metal powder layer to be expanded, which is arranged between the sheet metal parts, is shown, in which the sandwich component has additional reinforcing elements in individual cross-sectional areas, and the said reinforcing elements are connected in a positive-locking manner to the expanded metal powder layer surrounding same, and the said metal powder layer is in turn connected to the outer, massive metallic sheet metal parts in such a way that it cannot be detached without destruction.

Moreover, a process for manufacturing the sandwich component is disclosed, in which a massive metallic sheet metal part 4, 5 each is provided with a metal powder layer 6, 7; the two sheet metal parts 4, 5 are subsequently arranged one on top of another with the sides provided with the metal powder layer 6 and 7 facing each other, and the sheet metal parts lying one on top of another are then heated up such that a connection which cannot be detached without destruction is established between the metal powder layers 6, 7 facing one another by a heat-induced expansion process.

4 Claims, 1 Drawing Sheet

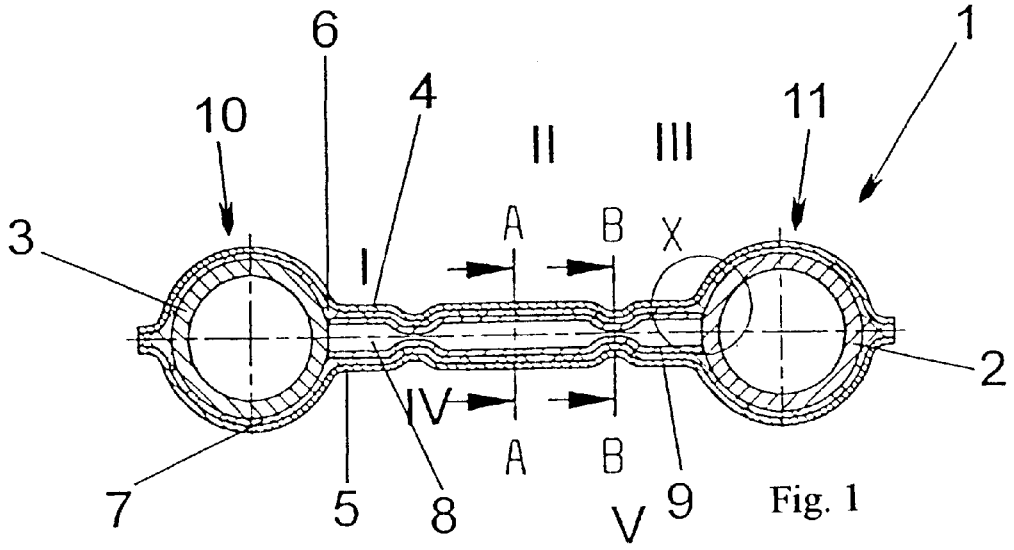
Fig. 1
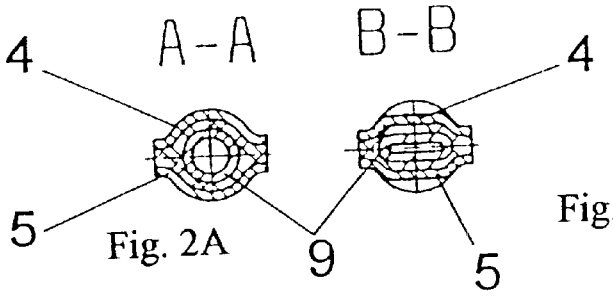
Fig. 2A
Fig. 2B
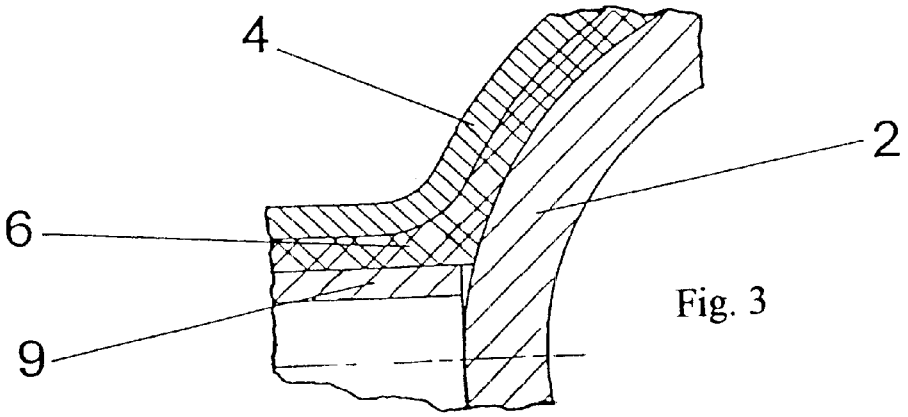
Fig. 3

COMPOSITE PART CONTAINING METALLIC FOAM AND METHOD FOR PRODUCING SAID COMPOSITE PART

FIELD OF THE INVENTION

The present invention pertains to a sandwich component, which comprises at least two massive metallic sheet metal parts located opposite each other and a metal powder layer arranged between the sheet metal parts, which is to be expanded as well as to a process for manufacturing the sandwich component.

BACKGROUND OF THE INVENTION

Sandwich components of the type described in the introduction are used in various areas of industry and especially in vehicle manufacture, because they have a relatively low weight at high rigidity.

The process for manufacturing such sandwich components is usually carried out in a plurality of steps. A sandwich blank is first manufactured from massive metallic sheet metal plate parts and the metal powder layer, e.g., by a roll-bonding operation. The rolling operation brings about a metallic bonding between the middle metal powder layer and the inner sides of the massive metallic sheet metal plate parts covering this metal powder layer. After the conclusion of the rolling operation, the sandwich-like plate material can be separated into individual parts by punching, and a changed shape is subsequently imparted to the individual to parts, e.g., by deep-drawing or similar processing steps. Certain boundary conditions, which are patented, e.g., in DE 196 12 781 C1, are to be complied with in this connection. It is described in that document that after the shaping of the sandwich-like shaped blank, this blank is introduced for the final manufacture into an expanding mold adapted with one wall to its end-contoured side and is subjected to a heat treatment in a suitable manner. Due to the fact that an expanding agent is added to the metal powder layer, expansion of the metal powder layer is brought about by the thermal effect. This expansion operation is terminated when the second massive metallic cover layer has come to lie on the second contact surface of the expanding mold.

Due to the above-described sequence of the manufacturing steps, it is possible to manufacture lightweight metallic components for a constantly dimensionally accurate quantity production, especially in vehicle manufacture, from flat, sandwich-like shaped blanks.

Moreover, manufacturing processes in which metal powder is expanded in a corresponding mold and the blank thus manufactured is later introduced into a casting mold and is subsequently finished, e.g., by diecasting into a sandwich component with an expanded core and an outer, massive metallic shell, are known from the state of the art. Such a manufacturing process has been known, e.g., from DE 195 01 508 C1.

Even though the various above-described manufacturing processes make it possible to manufacture sandwich components which make possible increased energy absorption compared with massive components and have a substantially better damping because of the acoustic conditions, a special partial stiffening of the sandwich components to provide increased rigidity adapted to the external conditions is not possible with the processes described. Rigidity is not possible because additional reinforcing elements would have to be introduced only in certain cross sections of the sandwich component. The introduction of such reinforcing elements is possible according to the state of the art only by means of welded and riveted constructions. Using such process steps, it is possible to introduce reinforcing elements between two massive metallic cover layers and to lock them in a positive-locking manner. However, such a manufacturing process is complicated in terms of the production technology and is associated with increased manufacturing costs as a result.

SUMMARY AND OBJECTS OF THE INVENTION

The technical object of the present invention is therefore to improve a sandwich component of this type such that the increased requirements, especially in the automobile manufacturing technology, in terms of increased rigidity, are met with a reduced weight of the component and to provide a process for manufacturing same.

This technical object is accomplished according to the present invention by the sandwich component having additional reinforcing elements in individual cross-sectional areas, which reinforcing elements are connected in a positive-locking manner to the expanded metal powder layer surrounding them, which said metal powder layer is in turn connected to the outer, massive metallic sheet metal parts in such a way that it cannot be detached without destruction.

This special design makes it possible, for the first time ever, to optimally adapt the moments of resistance opposing the special stresses occurring within chassis components corresponding to these special stresses. This can be achieved, on the one hand, by the different designs of the inner reinforcing elements by manufacturing these, e.g., from square profiles, flat materials or U profiles. Moreover, it is possible to correspondingly adapt the material of the reinforcing elements, so that, e.g., even materials such as titanium or the like may be used in the reinforcing elements for the highest stresses.

The process according to the present invention for manufacturing such sandwich components makes possible, compared with the state of the art, the design of the sandwich components according to the present invention in the first place; moreover, the manufacturing process is characterized by the sequence of simple and inexpensive process steps. The process for manufacturing a sandwich component, which requires for the manufacture at least two mutually opposite sheet metal parts and an expandable metal powder layer arranged between the sheet metal parts, is specifically described by the process steps of providing a massive metallic sheet metal part each with a metal powder layer, of subsequently arranging the two sheet metal parts with their sides provided with the metal powder layer facing one another one on top of another, and of finally heating the sheet metal parts lying one on top of another by supplying heat such that a melting process is brought about in the metal powder layers facing one another due to the supply of heat, which melting process brings about an undetachable connection of the metal powder layers.

Thus, a "bonding" of the metal powder layers facing one another is achieved by this process. Moreover, this process makes it possible to arrange additional reinforcing elements in the form of shaped sheet metal parts or profiles before the heating of the sheet metal parts lying one on top of another between these sheet metal parts in certain partial areas of the sandwich component, and these reinforcing elements are connected to the expanded metal powder layer during the subsequent expansion operation in such a way that they cannot be detached without destruction. A sandwich component, which has an especially high moment of resistance in partial areas and which can be manufactured especially inexpensively, is thus obtained.

An exemplary embodiment of the sandwich component according to the present invention will be explained in greater detail below on the basis of the attached drawings and the process for manufacturing the sandwich component will be described.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiment of the invention are illustrated.

BRIEF DESCRIPTION OF THE DRAWINGS

In the drawings:

FIG. 1 is a cross-sectional view through a motor vehicle suspension arm as an example of a sandwich component according to the present invention;

FIG. 2A is sectional views corresponding to line A—A and B—B in FIG. 1;

FIG. 2B is sectional views corresponding to line B—B in FIG. 1; and

FIG. 3 is an enlarged detail of detail X from FIG. 1.

DESCRIPTION OF THE PREFERRED EMBODIMENTS

Referring to the drawings in particular, the sandwich component, designated in its entirety by 1, has two carrying pipes 2 and 3. The carrying pipes 2 and 3 are connected to one another by an upper cover plate 4 and a lower cover plate 5. A metal powder layer 6 and 7 each is rolled onto the inner sides of the cover plates 4 and 5 facing the respective carrying pipes 2 and 3. The cover plates 4 and 5 are shaped in the area between the pipes 2 and 3 such that a connection web 8 is formed. The cover plates 4 and 5 are designed in the area of the connection web such that a hollow space is formed between them. A reinforcing element in the form of a connection linkage 9 is inserted into this hollow space in this exemplary embodiment. This connection linkage is designed such that it has three areas I, II and III of ring-shaped cross section and two areas IV and V of an essentially rectangular cross section. The shape of the cross sections is clearly seen in FIG. 2. This figure shows that the cover plates 4 and 5 lie with their metal powder layers on the respective outer edges of the connection web 8 and the metal powder layers 6 and 7 completely surround the connection linkage 9 inside the connection web 8.

The different shapes of the cross sections in areas I through III and IV and V are due to different requirements on the moments of resistance in the area of the sandwich component. It is, of course, also conceivable in this connection to impart square or any other cross sections to the connection linkage 9 instead of the round or rectangular cross sections being shown here, depending on the needs.

The view in FIG. 3 shows clearly once again that the metal powder layers applied to the respective cover plates completely surround both the carrying pipes 2 and 3 and the connection linkages 9 in the finished state, so that a positive-locking connection, which cannot be detached without destruction, is established between the individual components of the sandwich component 1.

The manufacturing process for the sandwich component 1 being shown here comprises the following process steps:

The lower cover plate 5 as well as the upper cover plate 4 are first coated with a respective metal powder layer 6 and 7. This coating is usually carried out by a rolling operation, by which a firm connection is established between the metal powder layer and the cover plate. This metal powder layer may consist, e.g., of aluminum powder with a corresponding expanding agent, e.g., titanium hydride ($TiH_2$). After the rolling operation, the cover plates 4 and 5 are provided with the contour shown in FIG. 1 in a shaping operation. This contour is characterized in that it has two areas 10 and 11 for receiving the carrying pipes 2 and 3 as well as an area located between them for receiving the connection linkage 9. When the upper cover plate 4 and the lower cover plate 5 are placed one on top of another, hollow spaces for receiving the corresponding pipes 2 and 3 as well as the connection linkage 9 are formed. The putting together of the individual components of the sandwich component is another process step within the framework of the manufacturing process.

Once the individual components of the sandwich component have been fitted together in the manner described, the sandwich component 1 is subsequently heated, e.g., in an oven, to a temperature necessary for the melting of the metal powder layer, which may reach values that are just below the melting point of the cover plates. Thus, temperatures between about 600° C. and 800° C. are possible. The expanding agent contained in the metal powder layers now releases gases which act similarly as in the case of the expansion of polyurethane foam and cause the aluminum powder mixture to expand. A positive-locking connection is brought about between the metal powder and the pipes 2 and 3 or the connection linkage 9 during the expansion operation. For example, AlMgSiI may be used as the material for the cover plates.

FIG. 3 shows once again in an enlarged detail that the metal powder layer completely fills the hollow spaces present between the cover plates 4 and 5 and the inner reinforcing components 2, 3 and 9. At the same time, a firm connection is brought about in the form of a bonding in the outer areas of the cover plates 4 and 5 in the areas in which the metal powder layers 6 and 7 lie directly on one another. A compact chassis component, which is optimally adapted to the boundary conditions in terms of strength and light weight and which is characterized by simple and inexpensive manufacture, is thus obtained after the cooling of the sandwich component.

In addition, it is, of course, conceivable within the framework of the carrying out of the process according to the present invention to additionally embed additional mounts, e.g., for rubber bearings as they are used in suspension arms during the expansion process in the sandwich component, without an additional operation, e.g., welding of the mounts to the sandwich component, having to be performed. In addition, the heat treatment of the sandwich component can be controlled such that it is combined with the heat treatment of the aluminum material, which is necessary anyway. This additionally increases the economy of the manufacture of the components according to the present invention. Due to the use of the inner reinforcing parts, sufficient strength is achieved, on the one hand, and the expanded metal used brings about at the same time an improvement in the acoustic properties, because it has a substantially better damping than usual solid materials.

Besides the improved acoustic properties, the expanded metal is additionally able to absorb increased amounts of energy because of its porosity. This may be advantageous for the deformation behavior of the sandwich component according to the present invention, e.g., in the case of a crash.

While specific embodiments of the invention have been shown and described in detail to illustrate the application of the principles of the invention, it will be understood that the invention may be embodied otherwise without departing from such principles.

What is claimed is:

1. A sandwich component, comprising:

at least two metallic sheet metal parts located opposite one another;

a metal powder layer to be expanded, which is arranged between the sheet metal parts;

reinforcing elements at individual cross-sectional areas, said reinforcing elements being connected in a positive-locking manner to said metal powder layer surrounding said reinforcing elements, said metal powder layer in turn being connected to the outer metallic sheet metal parts in such a manner that the connection in a positive locking manner cannot be detached without destruction.

2. A process for manufacturing a sandwich component which comprises at least two metallic sheet metal parts located opposite one another and a metal powder layer to be expanded, which is arranged between the sheet metal parts, the process comprising:

providing the at least two metallic sheet metal parts with the metal powder layer;

subsequently arranging the two sheet metal parts one on top of another with their sides provided with said metal powder layer facing each other;

inserting a shaped sheet metal part between said two sheet metal parts;

subsequently heating said sheet metal parts lying one on top of another by supplying heat such that a connection that cannot be detached without destruction is established between said metal powder layers facing one another by a heat-induced expansion process.

3. A process in accordance with claim 2, wherein said metal powder layers consist of expandable aluminum.

4. A sandwich component, comprising;

a first metallic sheet metal part;

a second metallic sheet metal pan located opposite said first metallic sheet metal part;

a metal powder layer to be expanded, which is arranged between said first sheet metal part and said second sheet metal part:

reinforcing elements at individual cross-sectional areas, said reinforcing elements being connected to said metal powder layer surrounding said reinforcing elements, said metal powder layer in turn being connected to the outer metallic sheet metal parts in such a manner that the connection cannot be detached without destruction.

* * * * *